United States Patent [19]

Valery

[11] Patent Number: 4,783,918

[45] Date of Patent: Nov. 15, 1988

[54] CASCADING CARD HOLDER

[76] Inventor: René Valery, 125 rue Houdan, Sceaux, France

[21] Appl. No.: 893,308

[22] PCT Filed: Oct. 28, 1985

[86] PCT No.: PCT/FR85/00304

§ 371 Date: Jul. 18, 1986

§ 102(e) Date: Jul. 18, 1986

[87] PCT Pub. No.: WO86/03166

PCT Pub. Date: Jun. 5, 1986

[30] Foreign Application Priority Data

Nov. 20, 1984 [FR] France ..... 84 17643

[51] Int. Cl.[4] ..... G09F 1/10

[52] U.S. Cl. ..... 40/124; 40/124.2; 40/124.4; 40/382; 40/395; 40/397; 211/55; 446/2; 446/168

[58] Field of Search ..... 40/124, 124.2, 124.4, 40/446, 508, 380–384, 393–397; 446/168, 2; 211/55, 45, 47, 48, 59.4, 59.2, 40, 41

[56] References Cited

U.S. PATENT DOCUMENTS

| | | | |
|---|---|---|---|
| 1,209,818 | 12/1916 | Dumont | 40/124.2 |
| 1,508,779 | 9/1924 | Dumont | 211/55 X |
| 1,569,884 | 1/1926 | Ringler | 40/396 |
| 1,658,394 | 2/1928 | Rand | 211/55 X |
| 1,772,154 | 8/1930 | Martin | 40/397 |
| 2,493,530 | 1/1950 | De Saussure | 40/382 X |
| 2,650,594 | 9/1953 | Heilman | 40/395 X |
| 3,472,387 | 10/1969 | Olsen | 211/45 |
| 4,310,097 | 1/1982 | Merl | 211/59.2 |

FOREIGN PATENT DOCUMENTS

| | | |
|---|---|---|
| 577425 | 9/1924 | France . |
| 1529767 | 1/1968 | France . |
| 2231208 | 12/1974 | France . |
| 151007 | 1/1922 | United Kingdom . |
| 513063 | 11/1939 | United Kingdom . |

*Primary Examiner*—Gene Mancene
*Assistant Examiner*—J. R. Hakomaki
*Attorney, Agent, or Firm*—Larson and Taylor

[57] ABSTRACT

A system for the vertical display of information provided on a plurality of cards or similar display members includes an extended heads on each display member. The extended heads are supported on each side by a pair of parallel slideways. Each slideway includes a plurality of vertical supports spaced therealong and paired with a support on the other slideway. Thus, a respective pair of supports serves to support an extended head of a display member and a series of display members so supported is created. A cascading mechanism is also provided for sequentially moving each display member in a cascade to a lower pair of supports when a new display member is introduced into the pair of slideways.

13 Claims, 2 Drawing Sheets fig. 5
coupe c.c
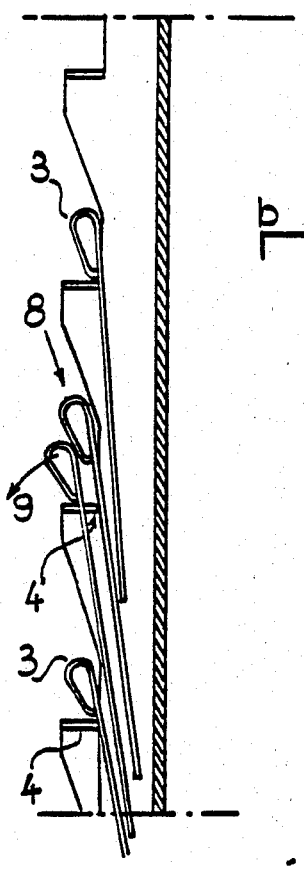
fig.3
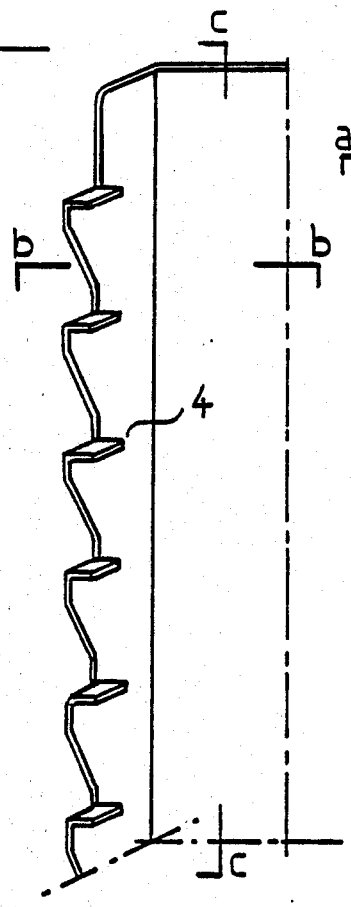
fig.1
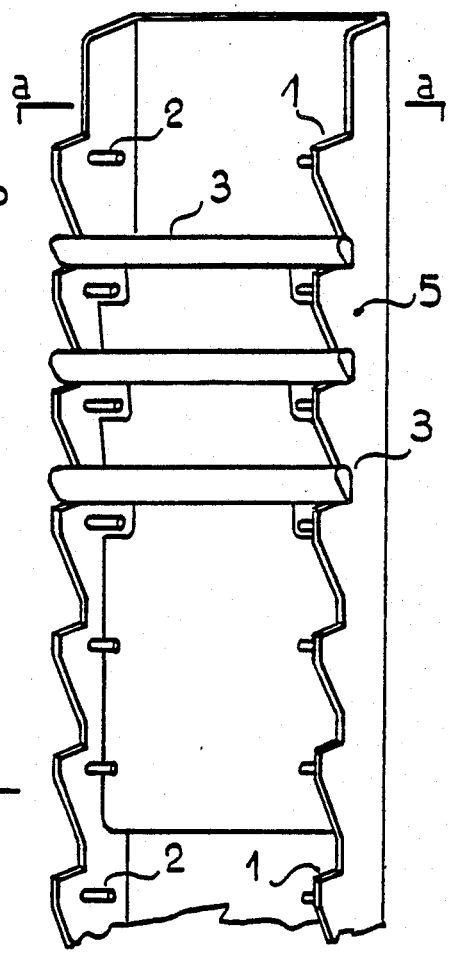
fig. 7
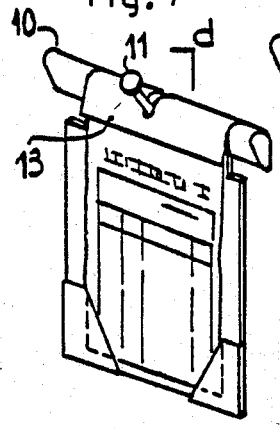
fig. 6
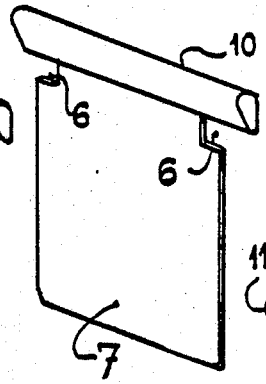
fig. 2 coupe a.a
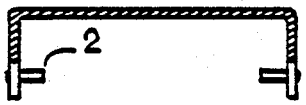
fig.8
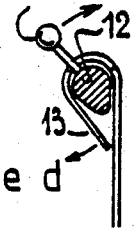
coupe d
fig. 4 coupe b.b
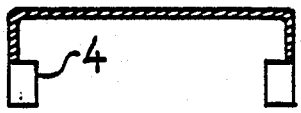

fig.9
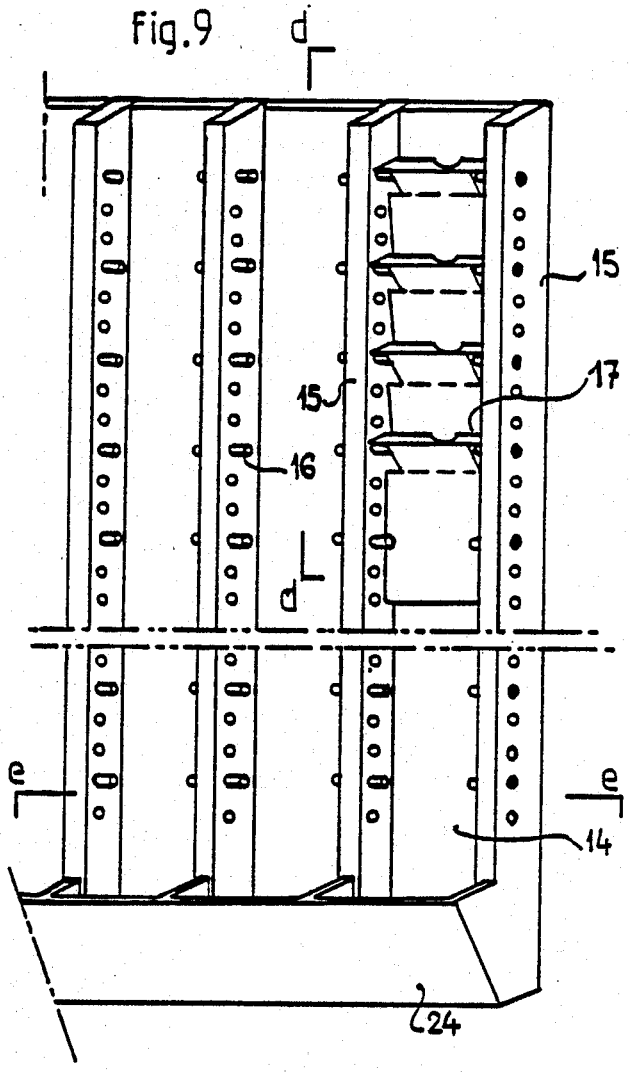
coupe d.d
fig.12
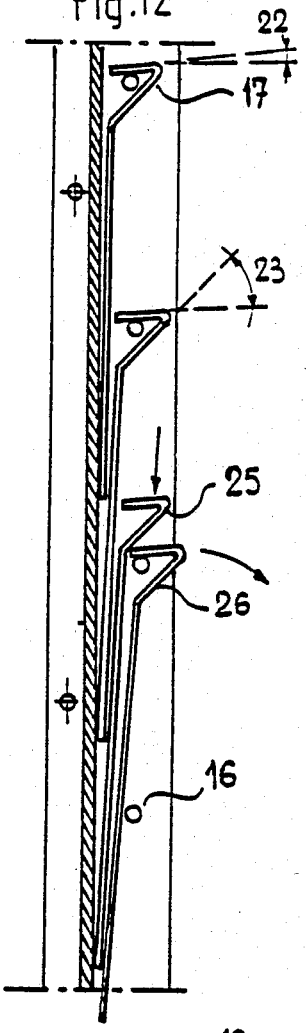
fig.10 coupe e.e
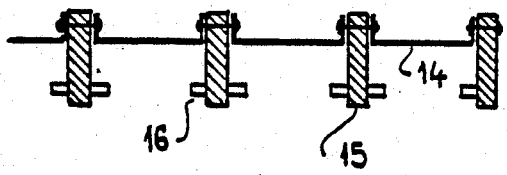
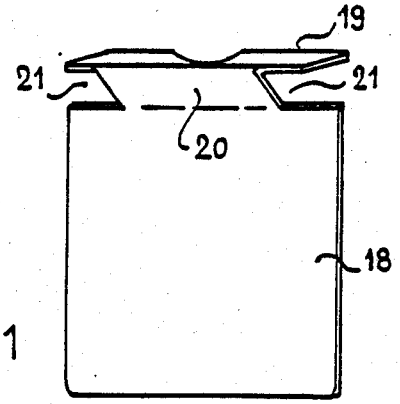
fig.11

CASCADING CARD HOLDER

The present invention relates to the fields;

of card indexes and plannings with vertical classification columns;

display tables with a cascading operation

In known devices in the field of card indexes and plannings displayed in adjacent vertical columns, the elements to be displayed called cards are introduced one above the other in superimposed slots. They are held in position by a wider head part bearing on the ends of the slots (card index with stubs).

If it is desired to insert a new card in a filled column in order to free a slot it is necessary beforehand to manually move a notch and one by one all those situated below or above the one chosen.

In other up-datable card index models, independent elements support the same stub cards. They are stacked one above the other in vertical slideways.

To remove an element from a column it is necessary with one hand to raise the stack situated above and with the other remove the carrier element, leaving an empty space which will be immediately reoccupied by the descent of the elements above.

For inserting a new element with one hand the stack above must be raised and with the other the new element introduced.

The change of position of the card requires each time these two successive handling operations. In a card index with a cascading operation these frequent handling operations are slow and tiresome.

The device of the invention allows these drawbacks in different fields to be remedied.

In that of frequently evolutive card indexes modifying the classification of the card displayed.

In work control, delivery, etc schedules which are organized as the orders of commands arrive. The documents: work vouchers, delivery vouchers, able to be displayed and made mobile and their order easily brought up to date.

It brings new possibilities in the field of remotely visible panels with classification display modified by successive sequences. Individual sporting test results, for example.

It may also find an interest in number and letter handling games.

Generally, the device of the invention is characterized in that it is formed of two sorts of distinct elements, namely:

independent and mobile elements to be displayed and fixed elements which may be called slideways supporting the first ones.

Different variants concerning these elements and relating to the present invention provide adaptation to the field of use and to the particular application requirements.

The fixed elements are generally formed of vertical or inclined strips, forming a slideway having a bottom and two flanges, which may be called slideways.

According to the application these slideways may be permanently fixed and adjacent so as to form a wall mounted holder or display table.

They may also be independent, or belong to the same support on which they are hooked while remaining movable, which allows their position to be modified with respect to each other.

These slideways serve both as guide and as support for the mobile elements. For this, the slideway flanges have projections called teeth, pegs or spurs. They are disposed one below the other, the spacing of the supports determining the displayed width of the elements which are there positioned.

The mobile elements are formed:

of a flat surface intended to receive the inscriptions. They will remain displayed in the upper part and hidden for the part introduced behind the element positioned below.

The inscriptions may be written on the surface itself provided that it is readily erasable so as to ensure the continual reutilization of the element, or be written on independent supports applied to the flat surface, or adhesive, or clipped at the top, or retained by slides integral with this element.

When they are carried by vertical slideways, the upper part of the surface of these elements is notched below the head so as to allow this latter to move away without being retained by the spur which was guided it up to this support. Which is not necessary when the slide ways are inclined, since they do not have any spur.

Of a head which may either be formed from the same material as the fixed part or be an added and secured piece. This head allowing the mobile element to bear on two pegs, spurs or teeth of the same level and whose essential characteristics obtained by the form which is given are:

that if the head is moved away from the bottom of the slideway the fall of the element is caused as far as the pegs situated below.

that if it is already an element positioned thereon the head meeting the one below which it moves aside for reaching the supports on which it will stop and causes the fall of the element which is situated there.

According to the essential characteristic of the invention, when , in a column of superimposed elements, one is added at the head or one is inserted between two others in this column, the added element will move aside the head of the one below which will cause its fall. This latter will in its turn cause the fall of the next one and so one, all the cards situated below will thus descend automatically one notch in cascade, until they find an available position.

According to another characteristic of the invention, if the column reaches the lowest position, the last element moved aside will leave the last supports and will fall into a receptacle; this receptacle may contain several mobile elements and also serve as reserve for other available.

In the description which follows the elements to be displayed which may be, depending on the field of application, cards, documents, tables, charts, etc. will be systematically called cards.

In a first variant the device is characterized by slideways whose projections are formed by teeth cut out from its flanges. In this variant the cards are of the stub or laterally extended head type, the side edges of the head bearing on the teeth. These cards are further easily remountable by causing them to slide manually from one tooth to another by simple upward pressure. In this arrangement the slideways must be moved apart at the foot so that the moving cards fall by gravity onto the teeth below.

According to a characteristic added to this device, for obtaining the same result with perfectly vertical slideways, the flanges of the toothed slideways further have spurs preventing the cards from being ejected from the vertical slideway when their head is moved away therefrom and guide them to the next support. The cards must then comprise under the head two notches allowing them to escape from the spurs so as to begin their next movement.

According to a new characteristic varying with the preceding one the teeth comprise a horizontal part forming a peg, serving both for supporting and guide for the cards, thus replacing the spur required in the preceding construction. In a variant concerning the cards (or mobile elements of another application) their head has a clip for supporting an independent element to be displayed. For this, the head may be formed so as to constitute an ovalized and longitudinally open tube for freeing a lip forming a clip, another tube also ovalized contained in the first one is secured to a handle extending forwardly. Its operation causes rotation of the inner tube and raising of the clip forming lip under which the document is introduced, it will be sufficient to bring the handle back to its first position for it to be clipped there.

In a second variant the device is characterized by slideways whose projections are formed by spurs supported by the flanges, these spurs serving both as support and guide for the cards; and by cards whose head of the same width as the flat part slides entirely between the flanges. The head of the cards comprises a practically horizontal surface which bears on the spurs, which surface is slightly inclined rearwardly for better ensuring its support and a surface inclined reversely to the first one whose role is to move aside the card head which it will meet; two lateral notches at the ends of this surface allow it to avoid, at the end of falling, the spurs on which the first surface will come to bear. In this device, the holes intended for the spurs may be super abundant and at regular intervals, and the spurs readily movable so as to allow the user himself to choose the spacing of the supports, so of the displayed surface of the positioned cards and even to vary the spacing in the same slideway.

The different devices forming the object of this description comprising fixed slideways and mobile elements forming together a module may may take on different forms of presentation; either as independent modules, or as a succession of fixed adjacent modules grouped in a table, or several removable modules fastened to the same support on which they are easily removable.

This possibly allows adaptation to the different utilisations and to the different fields of application.

The device of the invention is represented by the following drawings, giving the construction of two variants forming the object of the description, applicable to cascading card indexes.

FIG. 1 shows an independent module, of the toothed type, carrying cards with an extending head.

FIG. 2 is a horizontal sectionof the module.

FIG. 3 shows peg teeth.

FIG. 4 is a horizontal section of this module.

FIG. 5 is a section showing the action of the moving cards.

FIG. 6 shows a card.

FIG. 7 shows a card of the same type with a clip.

FIG. 8 is a vertical section of the clip carrying head.

FIG. 9 shows a holder or table formed of spur modules supporting cards without border.

FIG. 10 is a horizontal section of this holder or table.

FIG. 11 shows a card of constant width.

FIG. 12 is a vertical section of a module of the holder or table shown in FIG. 9 showing the action of the moving cards.

FIG. 1 shows a module having teeth 1 cut out from the flanges 5 of the slideway; the card 3 bear on the teeth by the edges of the laterally extended part forming their head. The module is shown in a vertical position which requires the spurs 2 preventing the cards from being ejected from the slideways during their movements.

FIG. 2 shows the slideway in horizontal section.

FIG. 6 shows the cards suitable for this use. They comprise a head with an extended part 10, two notches 6 allowing them to be disengaged from their support when escaping from the spurs, and a flat surface intended to receive the inscriptions 7.

This module may also be used in an inclined position. In this case, the spurs 2 of the slideways and the notches 6 of the cards are useless, the moved card fall naturally back onto the teeth by gravity.

FIG. 3 is a variant of the teeth of FIG. 1 in that each tooth has a peg 4 projecting inwardly of the slideway (see FIG. 4 section BB). These pegs have both the function of supporting the reglets and of guiding the moving cards, thus replacing the spurs.

The same cards shown in FIG. 6 are suitable for this use.

FIG. 5 shows, in a vertical section of the module of FIG. 3, the dynamic progress of the cards; the cards 3 are seen there in the static position, then a card 8 during the downward movement guided by the edge of pegs 4 and whose head at the end of falling moves that of card 9. This latter will be moved off its pegs 4 causing it to fall in its turn, guided by the pegs 4 of the next tooth, which thus prevents it from being ejected outside the slideway. The dynamic progress is started, the falling card 9 will in its turn cause that of the next one by a space and so one, in cascade, of all those situated below.

FIG. 7 shows a card with strip whose variant with respect to that of FIG. 6 consists in its possibility of clipping a document to be displayed against its flat face. In this example, the clip is formed by an ovalized rod 12 contained in the median part of the reglet 10 integral with the handle 11.

FIG. 8 is a section CC of FIG. 7 showing the device constructed. The head is partly of an ovalized tubular shape, open longitudinally in its median part for freeing the lip 13. Operation of the handle 11 causing rod 12 to pivot causes the moving aside or lowering of the lip intended to clip the introduced document.

This type of toothed construction allows easy raising of the cards by a simple upward manual pressure.

FIG. 9 shows a table formed of modules relating to the second variant described. In this construction the slideways are formed by vertical strips assembled together so as to form bottoms 14 and the slideway borders 15. The borders support spurs 16 which will serve both for supporting the cards 17 and as guides for preventing them from being ejected outside the slideways during their movements.

FIG. 10 is a horizontal section of the device showing a means of constructing this adjacent module table.

FIG. 11 shows a card of continuous width having a flat surface 18 intended for the inscriptions, a surface 19 close to the horizontal and slanted slightly rearwardly through a certain angle 22 for bearing on the spurs 16;

another surface 20 joining the two preceding ones 18 and 19 inclined by a certain angle 23 for moving aside the card behind which it slides during its fall, and of reduced width so as to form two notches 21 allowing it at the end of falling to avoid the spurs 16 on which the surface 19 will bear.

FIG. 12 shows the dynamic process of the invention identical to that described above; namely a card 25 falls while sliding behind the card 26. The head of the first one at the end of falling moving aside that below, causing the following ones to fall in cascade. The card situated on the lowest pegs will finish its fall in the receptacle 24 situated at the lower part of the slideway.

In the device shown in FIG. 9 the flanges of the slideways are provided with numerous closely spaced holes for receiving the spurs; since these latter are removable the user may choose or modify the spacing of the supports by placing or moving the spurs 16.

I claim:

1. A system for a vertical display of various information comprising:

a plurality of display members, each said display member including a top edge, opposite side edges, a flat display surface for an information, and a member support means provided at the top edge of said display member for supporting said display member, said member support means including an elongated head extending at least along the entire length of the top edge of said display member and having a head end at each end of said elongated head;

a pair of parallel slideways, each side slideway including (a) a retaining means for retaining a respective side edge of said display member adjacent thereto and (b) a series of supports vertically spaced along each said slideway, each said support of one said slideway forming one of a paired set of supports with a said support on the other side sideway such that on a respective paired set of supports respective said head ends of each said display member rest to support said display member and such that a plurality of said display members are individually supported one below another along said pair of slideways by respective said paired sets of supports and retained therein by said retaining means; and a cascading means for sequentially moving each said display member in a cascade to a lower adjacent set of supports when a new display member is introduced into said pair of slideways.

2. A system for the vertical display of information as claimed in claim 1 wherein said cascading means includes an inclined surface adjacent each said head for pushing said head of a lower adjacent said display member off of the associatged set of supports when said inclined surface is lowered into contact therewith.

3. A system for the vertical display of information as claimed in claim 2 wherein each said slideway is formed as a toothed rack, each said rack having teeth and each said tooth being provided with a substantially horizontal edge forming a said support and a bevelled lower edge joined to said substantially horizontal edge of an adjacent underlying said tooth.

4. A system for the vertical display of information as claimed in claim 3 wherein each toothed rack has an inner face adjacent said side edges of said display members; wherein said retaining means includes a series of respective spurs on each said inner face opposite one another; and wherein said member support means includes a lateral notch below each said head end such that respective said spurs pass through respective said notches as said head is pushed off of said supports.

5. A system for the vertical display of information as claimed in claim 3 wherein each said toothed rack further includes a series of pegs, each said peg of one said toothed rack extending horizontally from a respective said horizontal edge toward a corresponding said peg on the other said toothed rack such that said pegs form said supports and said retaining means.

6. A system for vertical display of information as claimed in claim 1 wherein said head comprises a substantially horizontal surface provided at an upper end of said inclined surface; and wherein said supports and said retaining means comprise a series of spurs on each said slideway, each said spur of one said slideway extending outwardly from a respective said slideway toward a corresponding said spur on the other said slideway such that said head ends rest on said spurs and respective said side edges are retained by associated said spurs.

7. A system for the vertical display of information as claimed in claim 6 wherein said substantially horizontal surface is slightly slanted downwardly toward a remainder of said inclined surface.

8. A system for the vertical display of information as claimed in claim 2 wherein said head has an ovalized cross-sectional shape with a lower thinned portion which forms said inclined surface.

9. A system for the vertical display of information as claimed in claim 8 wherein said head includes an integral clip for fixing a document having the information thereon to said display member and a handle for actuating said clip.

10. A system for the vertical display of information as claimed in claim 2 wherein said inclined surface is connected to said display surface.

11. A system for the vertical display of information as claimed in claim 10 wherein said inclined surface includes a notch located below each said head end of said head.

12. A system for the vertical display of information as claimed in claim 10 wherein said head is a substantially horizontal surface provided at a top edge of said inclined surface.

13. A surface for the vertical display of information as claimed in claim 12 wherein said substantially horizontal inclined surface is slightly slanted downwardly toward a remainder of said inclined surface

* * * * *